US007308750B2

(12) United States Patent
Tomiyama et al.

(10) Patent No.: US 7,308,750 B2
(45) Date of Patent: Dec. 18, 2007

(54) METHOD OF MANUFACTURING A MAGNESIUM DIAPHRAGM

(75) Inventors: Hiroyuki Tomiyama, Yamagata (JP); Masatoshi Sato, Yamagata (JP); Yoshimi Kudo, Yamagata (JP); Yuichi Kasahara, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 495 days.

(21) Appl. No.: 10/843,587

(22) Filed: May 12, 2004

(65) Prior Publication Data

US 2004/0231136 A1 Nov. 25, 2004

(30) Foreign Application Priority Data

May 20, 2003 (JP) ..... P2003-142504

(51) Int. Cl.
*H04R 31/00* (2006.01)

(52) U.S. Cl. ..... 29/594; 29/592.1; 29/609.1; 156/73.1; 156/250; 156/267; 156/292; 156/293; 156/297; 381/113; 381/116; 381/174; 381/191

(58) Field of Classification Search ..... 29/592.1, 29/594, 609.1; 156/73.1, 250, 267, 292, 156/293, 297; 381/113, 116, 191, 174
See application file for complete search history.

(56) References Cited

U.S. PATENT DOCUMENTS 4,344,503 A 8/1982 Nakamura et al.
4,765,954 A * 8/1988 Das et al. ..... 419/23
5,129,960 A * 7/1992 Chang et al. ..... 419/67
5,316,598 A 5/1994 Chang et al.

FOREIGN PATENT DOCUMENTS

| | | |
|---|---|---|
| EP | 0 339 855 A2 | 11/1989 |
| JP | 2002-369284 A | 12/2002 |
| WO | WO 91/13181 A1 | 9/1991 |

* cited by examiner

*Primary Examiner*—Paul D. Kim
(74) *Attorney, Agent, or Firm*—Sughrue Mion, PLLC

(57) ABSTRACT

In a rolling process, the level of rolling performed by a rolling mill for one operation is set to 1 μm to 20 μm. A magnesium substrate is rolled by rollers while being heated by a thermostatic chamber. As a result, there is manufactured a high-quality magnesium sheet which is less susceptible to influence of oxidation, which realizes a high internal loss, prevention of a drop in sensitivity, and low distortion, and which has a thickness of 30 μm to 100 μm. Further, as a result of the magnesium sheet being formed into a semi-dome shape or a dome shape, the sheet can be inexpensively manufactured as a speaker for high-tone playback. In particular, in the case of a magnesium diaphragm into which a dome section and an edge section are integrally formed, high-quality sound can be played back in a high frequency range without involvement of a drop in sensitivity.

14 Claims, 7 Drawing Sheets

FIG. 2A

ROLLING METHOD EXAMPLE 1

| PROCESS | THICKNESS (ONE ROLLING) | NUMBER (ROLLING) |
|---|---|---|
| 150μm → 130μm | 4μm | 5 TIMES |
| 130μm → 120μm | 2μm | 5 TIMES |
| 120μm → 100μm | 1μm | 20 TIMES |
| | | TOTAL: 30 TIMES |

FIG. 2B

ROLLING METHOD EXAMPLE 2

| PROCESS | THICKNESS (ONE ROLLING) | NUMBER (ROLLING) |
|---|---|---|
| 150μm → 80μm | 5μm | 14 TIMES |
| 80μm → 40μm | 2μm | 20 TIMES |
| 40μm → 30μm | 3μm | 2 TIMES |
| | 2μm | 1 TIMES |
| | 1μm | 2 TIMES |
| | | TOTAL: 29 TIMES |

METHOD OF MANUFACTURING A MAGNESIUM DIAPHRAGM

BACKGROUND OF THE INVENTION

1. Field of the Invention

The present invention relates to a magnesium diaphragm, a method for manufacturing the diaphragm, and a speaker for high-tone playback using the diaphragm.

2. Description of the Related Art

A polymer-based material (fibers or resin) or metal-based material has hitherto been preferably used as a diaphragm of a speaker for a high-tone playback (hereinafter called a "high-tone playback speaker"). The form of the high-tone playback speaker using the diaphragm encompasses various types, such as a dome-shaped speaker and a semi-dome-shaped speaker.

A resin film material; e.g., polyimide (PI), polyetherimide (PEI), or polycarbonate (PC), is used for a resin-based diaphragm for high-tone playback purpose. A resin-based diaphragm usually has a low acoustic velocity "c" (m/s). Therefore, the diaphragm has a physical property of a low frequency at which split resonance starts. Therefore, the high-tone playback speaker using any of these materials encounters a problem in playing back sound of a high-frequency range.

A material; e.g., aluminum or titanium, is used as a metal-based diaphragm for high-tone playback purpose. The metal-based diaphragm usually has higher rigidity than a resin-based diaphragm and, hence, has a physical property of being able to acquire a threshold frequency (fh) higher than that of the resin-based diaphragm. Therefore, the high-tone playback speaker using the material has an advantage of the ability to play back sound up to a high frequency range with little distortion.

However, the diaphragm using aluminum or titanium has a low internal loss (tan.). Therefore, when an "fh" has arisen in an audible range from 20 Hz to 20 KHz, a peak or a dip that appears in the high frequency range is larger than in the case of the resin-based diaphragm. Hence, the sound involves a high level of distortion.

In addition, the metal-based diaphragm has a high specific gravity and hence suffers a problem of a drop in efficiency of converting an input signal into output sound pressure, which in turn results in a drop in acoustic sensitivity. To solve the problem, there is adopted a method for reducing the thickness of the diaphragm, to thereby enhance acoustic sensitivity. However, according to this method, the diaphragm itself has decreased rigidity and becomes likely to cause undesired resonance. There arises a problem of the sound emitted from the diaphragm involving a lot of distortion.

In order to solve the foregoing problem in the resin-based diaphragm and that in the metal-based diaphragm using aluminum and titanium, attention has been paid to a diaphragm using magnesium as a metal-based diaphragm.

Specifically, there has been proposed a diaphragm for a speaker using, as material, a magnesium sheet or a magnesium alloy sheet (see, e.g., JP-A-2002-369284). According to the document, the diaphragm using the magnesium sheet or the magnesium alloy sheet is manufactured in the following manner. First, a wire or a plate, which is formed from magnesium or a magnesium alloy, is formed into a sheet material by a cross rolling method, and the sheet material is molded by a pneumatic molding method. As a result, there is manufactured a diaphragm made of a magnesium sheet or a magnesium alloy sheet, which has a thickness of 0.02 to 0.04 mm.

However, magnesium is susceptible to oxidation. When the thickness of magnesium has become about 30 μm or less, the hardness of magnesium increases under the influence of an oxide film, thereby raising a problem of deterioration of a characteristic of magnesium; that is, a high internal loss.

If the thickness of magnesium is increased to about 100 μm or more, the weight of the diaphragm will be increased, thereby raising a problem of deterioration of speaker performance and acoustic sensitivity.

When an effective area of the diaphragm using magnesium is increased, "fh" falls within an audible range, thereby raising a problem of sound involving a high level of distortion.

SUMMARY OF THE INVENTION

It is an object of the invention to provide a magnesium diaphragm which is not affected by oxidation and which realizes a high internal loss, prevention of deterioration of sensitivity, and a low level of distortion, as well as to a method for manufacturing the diaphragm and a speaker using the diaphragm.

According to the invention, a method for manufacturing a magnesium diaphragm, including the steps of:

heating a base material of magnesium; rolling the heated base material of magnesium for producing a magnesium sheet having a predetermined thickness at a plurality of times each of which is different from one another in terms of a level of rolling; producing the magnesium sheet by the rolling step; and forming a magnesium diaphragm in a predetermined shape from the magnesium sheet.

In one aspect of the present invention, a method for manufacturing a magnesium diaphragm, including the steps of: heating a base material of magnesium; rolling the heated base material of magnesium for producing a magnesium sheet having a predetermined thickness at a plurality of times each of which is different from one another in terms of a level of rolling; producing the magnesium sheet by the rolling step; and forming a magnesium diaphragm in a predetermined shape from the magnesium sheet.

According to the method for manufacturing the magnesium diaphragm, the level of rolling can be appropriately adjusted every time. By repeating processing pertaining to process, which differ from each other in terms of level of rolling, a plurality of times, a magnesium sheet can be manufactured from a magnesium base material. Subsequently, A magnesium diaphragm having a predetermined thickness can be manufactured by forming the magnesium sheet. When the magnesium diaphragm is manufactured, a magnesium base material which is a subject to the rolling process, is heated. Then the magnesium base material becomes suitable for rolling. As the magnesium base material becomes thinner, the level of rolling for one operation can be reduced process. As a result, the rolled magnesium base material can be prevented from undergoing occurrence of failures, such a cracking, warpage, or pin holes in the rolled magnesium base material. Therefore, an attempt to improve a yield can be realized.

In another aspect of the invention for manufacturing the magnesium diaphragm, the predetermined thickness ranges from 30 μm to 100 μm. The magnesium diaphragm can maintain a high internal loss without being affected by oxidation and which realizes low distortion without involvement of a drop in sensitivity.

According to yet another aspect of the invention for manufacturing the magnesium diaphragm, the level of rolling ranges 1 μm to 20 μm. According to this embodiment, the level of rolling for one operation is in microns. Therefore, there can be effectively prevented occurrence of cracks, warpage, or pinholes in the magnesium substrate having high rigidity, during rolling operation. The magnesium diaphragm of desired thickness can be manufactured with superior accuracy.

The forming process involves forming the magnesium sheet in a semi-dome shape or a dome shape. According to this embodiment, the magnesium sheet is formed into a semi-dome shape or a dome shape, which have become prevalent. A speaker for high-tone playback can be manufactured at low cost.

In yet another aspect of the present invention, the magnesium diaphragm for a speaker assumes a semi-dome or dome shape having a thickness of 30 μm to 100 μm.

According to the magnesium diaphragm for a speaker, the thickness of the diaphragm is set to be 30 μm or more, and hence the diaphragm realizes a high internal loss without being affected by oxidation. Since an internal loss is high, a peak or a dip in output sound pressure, which arises in a high frequency range, becomes smaller. A distortion, such as secondary distortion or tertiary distortion, is also reduced. Therefore, the output sound pressure is flat in the high-frequency range, and high-quality sound can be played back. Moreover, the thickness of the magnesium diaphragm for a speaker is 100 μm or less so that a lightweight diaphragm is achieved. So, the sensitivity of the diaphragm can be enhanced. In addition, magnesium has a high rigidity. A undesired resonance, which arises in magnesium in a high frequency range, is diminished so that sound can be produced with little distortion. Accordingly, sound can be played back up to an ultra high frequency range with little distortion.

In still another aspect of the invention, the speaker is equipped with the semi-dome-shaped or dome-shaped magnesium diaphragm which is manufactured according to the manufacturing method. The magnesium diaphragm has a thickness of 30 μm to 100 μm. According to the speaker, the magnesium diaphragm is formed into a semi-dome shape or a dome shape, which have become prevalent, a speaker for high-tone playback; e.g., a tweeter can be manufactured at low cost.

In the speaker, a dome section and an edge section are formed integrally in the magnesium diaphragm. As a result, sound is transmitted from a voice coil bobbin of the speaker to the magnesium diaphragm without a drop in sensitivity, so that high-quality sound in a high frequency range can be produced.

BRIEF DESCRIPTION OF THE DRAWINGS

FIGS. 2A and 2B show examples of rolling process of a magnesium substrate of the present invention;

DESCRIPTION OF THE PREFERRED EMBODIMENTS

A preferred embodiment of the present invention will be described hereinbelow by reference to the drawings.

In the present invention, a speaker for high-tone playback uses sheet-like magnesium rolled to a thickness of 30 μm to 100 μm as a diaphragm and which realizes a high internal loss, prevention of a drop in sensitivity, and low distortion without oxidation. There will now be described hereinbelow a rolling method for rolling a magnesium diaphragm to a thickness of 30 μm to 100 μm, an output sound pressure characteristic of the magnesium diaphragm in a high frequency range, and an example in which the magnesium diaphragm is formed into various shapes and applied to a speaker for high-tone playback.

Figure 1:
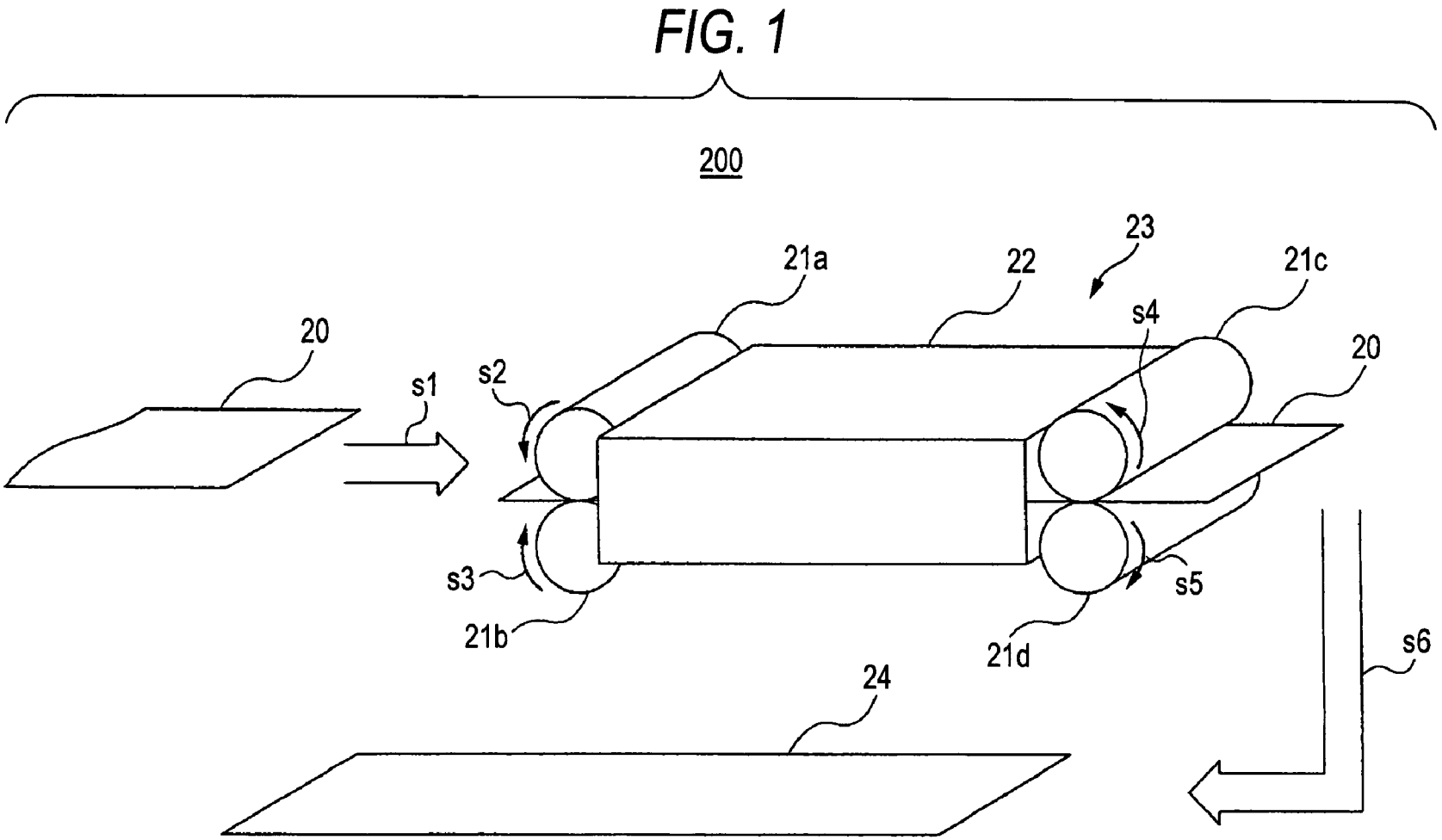
FIG. 1 shows rolling steps for manufacturing a magnesium sheet by rolling a magnesium substrate of the present invention.

First, a method for rolling magnesium according to the present invention will be described by reference to FIG. 1. FIG. 1 shows a rolling process 200 for rolling a magnesium substrate 20 into a magnesium sheet 24 having a thickness of 30 μm to 100 μm.

The magnesium substrate 20 is formed in advance into a sheet material having a thickness of 150 μm or thereabouts. In the rolling process 200, the magnesium substrate 20 is repeatedly rolled a plurality of times by a rolling mill 23, whereby the magnesium sheet 24 of a desired thickness is manufactured within the range of 30 μm to 100 μm (see arrow s6).

The rolling mill 23 includes rollers 21*a*, 21*b*, 21*c*, and 21*d* for rolling the magnesium substrate 20 to a predetermined thickness while rotating in a given direction and applying given tension to the substrate 20. A thermostatic chamber 22 for heating the magnesium substrate 20 to a predetermined temperature is also provided with the rolling mill 23.

The rollers 21*a*, 21*b*, 21*c*, and 21*d* can be adjusted to given tension by an unillustrated tension adjustment mechanism. The tension adjustment mechanism is adjusted to given tension by an operator operating a control panel. In the present embodiment, the rollers 21*a*, 21*b*, 21*c*, and 21*d* can make the magnesium substrate 20 thin within the range of about 1 μm to 20 μm through single rolling operation.

The thermostatic chamber 22 is a device for heating the magnesium substrate sheet 20 to a predetermined temperature. By an unillustrated temperature controller, the inside of the thermostatic chamber 22 is controlled to a given temperature. It is difficult to work magnesium at room temperature, since magnesium is of a close-packed hexagonal structure. For this reason, magnesium is rolled at a temperature of 200 to 400 degree or thereabouts by the thermostatic chamber 22. As a result, the magnesium substrate 20, which is less susceptible to plastic deformation, is brought into a state in which the substrate becomes more easily rolled.

The rolling process 200 will be described. First, the magnesium substrate 20 having a constant length and a constant thickness is fed to the rolling mill 23 by an unillustrated feeding apparatus (arrow s1). Next, the rollers 21*a*, 21*b* roll the magnesium substrate 20 to a predetermined thickness while rotating in a given direction (arrows s2 and s3) and also feed the magnesium substrate 20 to the thermostatic chamber 22. The magnesium substrate 20 is heated to a predetermined temperature while passing through the thermostatic chamber 22 and becomes easily deformed plastically. Next, when the magnesium substrate 20 is fed from the thermoplastic chamber 22 to the rollers 21*c*, 21*d*, the rollers 21*c*, 21*d* again roll the magnesium substrate 20 while rotating in a given direction (arrows s4, s5). The magnesium substrate 20 is finally processed into a magnesium sheet 24 having a thickness within the range of 30 μm to 100 μm (arrow s6).

When the magnesium substrate 20 is rolled, the level of rolling for one operation is set within the range of about 1 μm to 20 μm, since magnesium is a material which is much smaller than other kinds of metals in terms of the amount of slide deformation and hence is very difficult to deform plastically. Therefore, if the level of rolling for one rolling operation is set excessively high, failures, such as cracks, warpage, or pinholes, will arise in the magnesium substrate 20 under the influence of potential residual strain in the magnesium substrate 20 can be occurred. So, the process yield can be declined. Therefore, in the present embodiment, the level of rolling for one operation is about 1 μm to 20 μm. The magnesium substrate 20 is rolled a plurality of times, thereby solving the problem and realizing an attempt to improve a yield.

An example rolling method of the magnesium substrate 20 through the rolling process 200 will be described by reference to FIGS. 2A and 2B. FIG. 2A shows an example rolling method in which the magnesium substrate 20 is rolled from 150 μm to 100 μm (Rolling method example 1). FIG. 2B shows an example rolling method for rolling the magnesium substrate 20 from 150 μm to 30 μm (Rolling method example 2).

In the example rolling method 1 shown in FIG. 2A, the magnesium substrate 20 having a thickness of 150 μm is finally rolled to a thickness of 100 μm by way of three process; that is, a process for rolling a substrate from 150 μm to 130 μm; a process for rolling a substrate from 130 μm to 120 μm; and a process for rolling a substrate from 120 μm to 100 μm. Processing pertaining to any of the three process is performed by the previously-described rolling process 200.

In the first process for rolling the substrate from 150 μm to 130 μm, the tension of the rollers 21*a*, 21*b*, 21*c*, and 21*d* is adjusted. The extent to which the magnesium substrate 20 is rolled by one operation is set to 4 μm. The magnesium substrate 20 is repeatedly rolled five times by the rolling mill 23, whereby the magnesium substrate 20 is rolled to a thickness of 130 μm.

In the process for rolling the substrate from 130 μm to 120 μm, the extent to which the magnesium substrate 20 is rolled by one operation is set to 2 μm. The magnesium substrate 20 is repeatedly rolled five times by the rolling mill 23. As a result, the magnesium substrate 20 is rolled to a thickness of 120 μm.

In the last process for rolling the substrate from 120 μm to 100 μm, the extent to which the magnesium substrate 20 is rolled by one operation is set to 1 μm. The magnesium substrate 20 is repeatedly rolled twenty times by the rolling mill 23. As a result, the magnesium substrate 20 is rolled to a thickness of 100 μm.

In the example rolling method 1 shown in FIG. 2A, the magnesium substrate 20 is rolled at different levels a total number of 30 times, whereby the magnesium sheet 24 having a thickness of 100 μm is produced.

Next, according to the example rolling method 2 shown in FIG. 2B, the magnesium substrate 20 having a thickness of 150 .m is finally rolled to a thickness of 30 μm by way of three processs; that is, a process for rolling a substrate from 150 μm to 80 μm; a process for rolling a substrate from 80 μm to 40 μm; and a process for rolling a substrate from 40 μm to 30 μm.

In the first process for rolling a substrate from 150 μm to 80 μm, the extent to which the magnesium substrate 20 is rolled by one operation is set to 5 μm, and the magnesium substrate 20 is repeatedly rolled 14 times by the rolling mill 23. As a result, the magnesium substrate 20 is set to a thickness of 80 μm.

In the next process for rolling a substrate from 80 μm to 40 μm, the extent to which the magnesium substrate 20 is rolled by one operation is set to 2 μm, and the magnesium substrate 20 is repeatedly rolled 20 times by the rolling mill 23. As a result, the magnesium substrate 20 is set to a thickness of 40 μm.

In the final process for rolling a substrate from 40 μm to 30 μm, the extent to which the magnesium substrate 20 is rolled by one operation is set to 3 μm, and the magnesium substrate 20 is repeatedly rolled twice by the rolling mill 23. As a result, the magnesium substrate 20 is set to a thickness of 34 μm. Next, the extent to which the magnesium substrate 20 is rolled by one operation is set to 2 μm, and the magnesium substrate 20 is rolled once by the rolling mill 23. As a result, the thickness of the magnesium substrate 20 comes to 32 μm. Finally, the extent to which the magnesium substrate 20 is rolled by one operation is set to 1 μm, and the magnesium substrate 20 is repeatedly rolled twice by the rolling mill 23. As a result, the magnesium substrate 20 is set to a thickness of 30 μm.

According to the example rolling method 2 shown in FIG. 2B, the magnesium substrate 20 is rolled at different levels a total of 29 times, whereby the magnesium substrate 24 having a thickness of 30 .m is obtained.

In the example rolling methods 1 and 2, the level of rolling for one operation is set so as to decrease as processing proceeds to subsequent process. The reason for this is that the magnesium substrate 20 becomes thinner every time it is rolled and that the magnesium substrate 20 becomes liable to a deteriorate in rigidity and occurrence of failures, such as cracks, for reasons of a reduction in thickness. Therefore, in the three process shown in FIGS. 2A and 2B, occurrence of the failures is avoided by reducing the level of rolling as processing proceeds to subsequent process.

The example rolling methods 1 and 2 shown in FIGS. 2A and 2B are merely illustrative examples. The rolling method and the level of rolling for one operation are not limited to the examples.

The thus-formed magnesium sheet 24 is formed into a predetermined shape such as a dome shape or a semi-dome shape, whereupon a magnesium diaphragm for a speaker is manufactured.

Figure 3A:
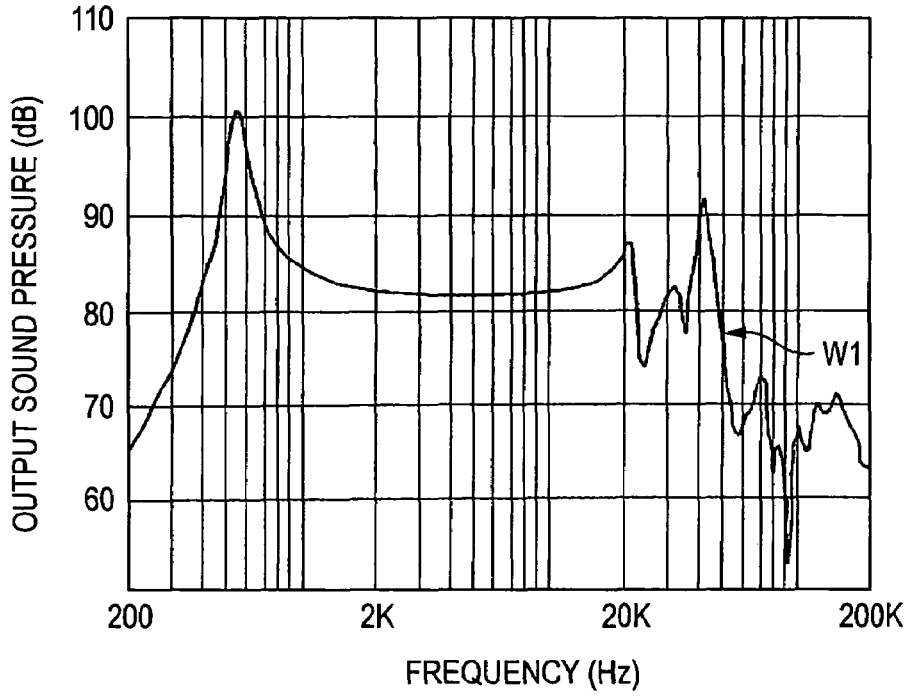
FIGS. 3A and 3B show an output sound pressure haracteristic of a magnesium diaphragm having a thickness of 30 .m and that of a magnesium diaphragm having a thickness of 100 .m of the present invention, respectively.
Figure 3B:
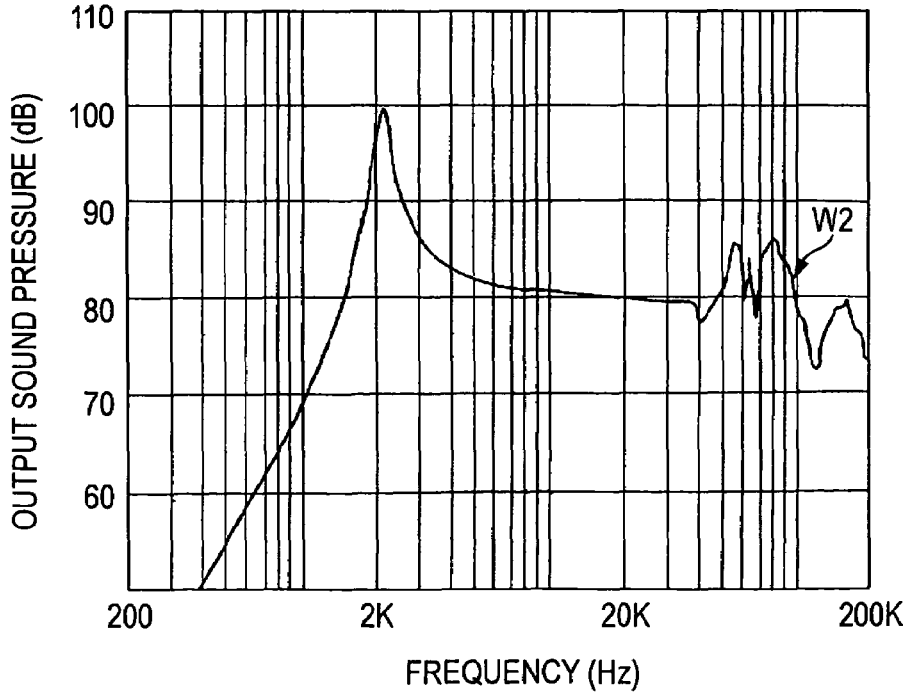

Next, FIGS. 3A and 3B show a graph showing exemplary measurement of sound pressure characteristics of the magnesium diaphragms in a high-frequency range which have been rolled through the foregoing rolling process 200 and which respectively have a thickness of 30 μm and a thickness of 100 μm. In the exemplary tests, the sound pressure output from the magnesium diaphragm when the frequency of an input signal has been changed is measured. A graph W1 shown in FIG. 3A shows a relationship between the frequency of an input signal (Hz) and output sound pressure (dB), both pertaining to a speaker utilizing the magnesium diaphragm having a thickness of 30 μm. A graph W2 shown in FIG. 3B shows a relationship between the frequency of an input signal (Hz) and output sound pressure (dB), both pertaining to a speaker utilizing the magnesium diaphragm having a thickness of 100 μm.

As indicated by the graph W1 shown in FIG. 3A, the speaker using the magnesium diaphragm having a thickness of 30 μm produces flat output sound pressure within the range of about 2 KHz to 20 KHz. In the meantime, as indicated by the graph W2 shown in FIG. 3B, the speaker using the magnesium diaphragm having a thickness of 100 μm produces flat output sound pressure within the range from levels around 10 KHz to a level immediately less than about 60 KHz. Specifically, in any case, a flat characteristic is obtained in the frequency of from 3 KHz to 20 KHz required by the speaker for high-tone playback. The magnesium diaphragm having a thickness of 30 μm and the magnesium diaphragm having a thickness of 100 μm show different output sound pressure characteristics despite using the same magnesium material. This is attributable to a difference in mass between the diaphragms leading to a change in the output sound pressure characteristic despite the same shape and size.

The magnesium diaphragms having a thickness of 30 μm and a thickness of 100 μm do not exhibit any peak (i.e., a crest in a specific frequency) in an audible range and therefore can playback sound in a high frequency range with little distortion.

Figure 4A:
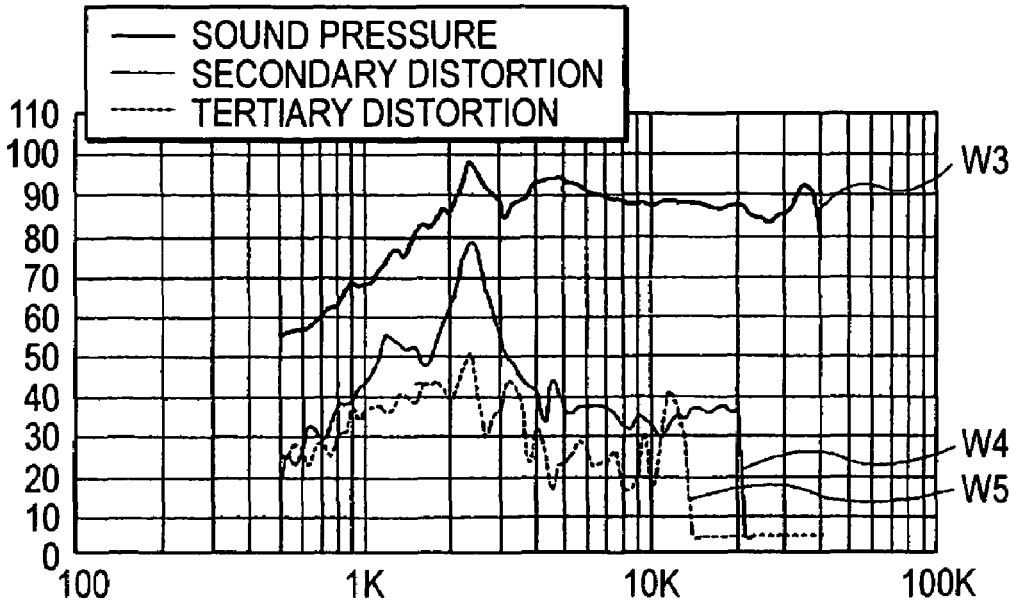
FIGS. 4A and 4B show comparison between an output sound pressure characteristic of the magnesium diaphragm of the present invention and that of a titanium diaphragm, respectively.
Figure 4B:
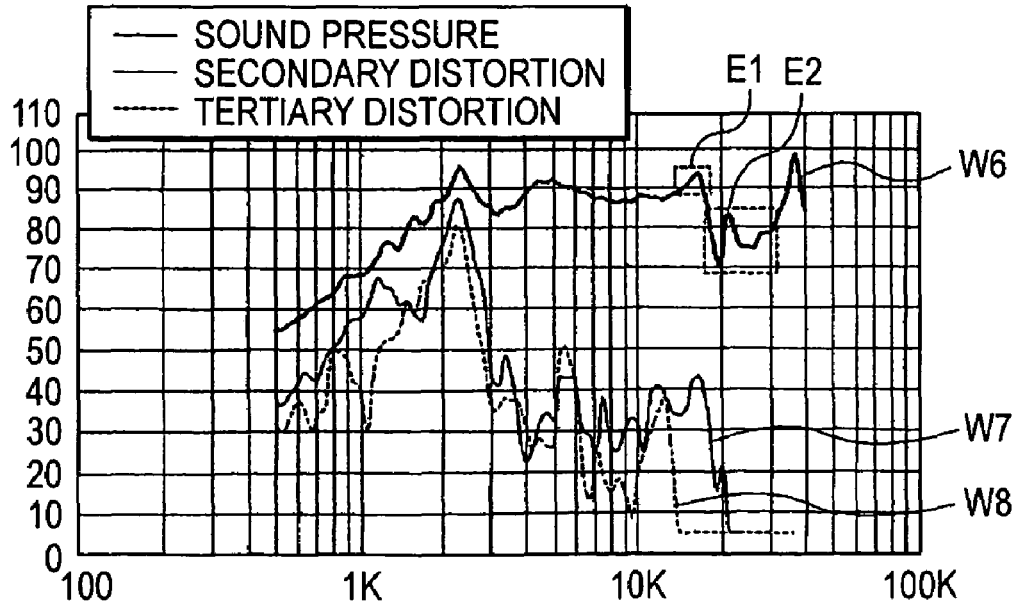

The output sound pressure characteristics of the magnesium diaphragms achieved in the high frequency range and those of a diaphragm using titanium achieved in the high frequency range are shown in the form of graphs in FIGS. 4A and 4B for comparison. Graphs W3 and W6 show output sound pressure (indicated by heavy solid lines), and graphs W4 and W7 show secondary distortion (indicated by fine solid lines). Graphs W5 and W8 are graphs showing tertiary distortion (indicated by broken lines). Characteristics shown in FIG. 4A belong to speakers utilizing magnesium diaphragms whose thicknesses fall within the range of 30 μm to 100 μm.

As indicated by the graph W3 shown in FIG. 4A, the magnesium diaphragm produces flat output sound pressure from about 3.5 KHz to about 30 KHz. As indicated by the graph W6 shown in FIG. 4B, titanium diaphragm produces flat the output sound pressure from about 4 KHz to about 15 KHz. Therefore, it is understood that the magnesium diaphragm can ensure a wider sound playback range in a high frequency than the titanium diaphragm and that the magnesium diaphragm can play back sound up to an ultra high frequency.

As can be seen from the graphs W3 and W6, the output sound pressure of the magnesium diaphragm is flat in the neighborhood of about 18 KHz in the audible range. In contrast, the output sound pressure of the titanium diaphragm has a peak in a broken-line region E1 (at about 18 KHz). Further, as can be seen from the graphs W3 and W6, the output sound pressure of the magnesium diaphragm is flat within the range of 18 kHz to 30 KHz. However, the titanium diaphragm produces many peaks and dips (i.e., crests and troughs at a specific frequency) (see a broken-line region E2). Therefore, the magnesium diaphragm is understood to be more suitable for use as a diaphragm for high-tone playback than the titanium diaphragm.

Secondary and tertiary distortion characteristics are shown in FIGS. 4A and 4B in the form of graphs. Particularly, the secondary distortion characteristic of the magnesium diaphragm and that of the titanium diaphragm, both characteristics having been achieved in the audible range of 3 KHz to 20 KHz, are compared with each other. As can be seen from graphs W4 and W7, the latter, titanium diaphragm is understood to have caused a larger number of peak and dips than the magnesium diaphragm. Moreover, the tertiary distortion characteristic of the magnesium diaphragm and that of the titanium diaphragm, both having been achieved in the same range, are compared with each other. As can be seen from the graphs W5 and W8, the latter titanium diaphragm is understood to involve a large difference between peaks and dips in the output sound pressure.

This indicates that the titanium diaphragm includes a lot of distortion components in the high frequency range as compared with the magnesium diaphragm. Therefore, the magnesium diaphragm is understood to be more suitable for use as a diaphragm for high-tone playback than the titanium diaphragm.

Even when the magnesium diaphragm is compared with a diaphragm which uses aluminum and which is not particularly shown in the embodiment, the latter aluminum diaphragm generates many peaks and dips in the high frequency range as compared with the magnesium diaphragm and shows a characteristic of inclusion of a lot of distortion components. Therefore, the magnesium diaphragm is more suitable for use as a diaphragm for high-tone playback than the aluminum diaphragm.

The above-described characteristics are chiefly attributable to physical properties of magnesium being higher than those of titanium and aluminum in terms of an internal loss and rigidity and magnesium being lighter in weight than titanium and aluminum. In particular, in the present embodiment, the magnesium diaphragm is formed to a thickness within the range of 30 μm to 100 μm. Hence, the diaphragm yields the following additional advantage.

When the thickness has become equal to or less than 30 μm, the magnesium diaphragm generally becomes harder under the influence of an oxide film and loses a physical property of high internal loss unique to magnesium. However, such a loss can be avoided. Moreover, when the thickness is increased to 100 μm or more, the mass of the magnesium diaphragm is increased, which would raise a problem of a drop in the performance of the speaker. However, this problem can also be avoided. Therefore, the magnesium diaphragm according to the present embodiment is less susceptible to influence of oxidation and can maintain a high internal loss and realize low distortion without involvement of a decrease in sensitivity. Hence, high-quality playback in a high frequency range becomes feasible.

As the effective area of the magnesium diaphragm is increased, the high limit frequency fh appears in the audible range, which in turn raises a problem of sound containing a lot of distortion. A diaphragm for high-tone playback purpose usually has a reduced effective area and is used in the form of a dome or semi-dome shape, as will be described later, and hence such a problem is solved.

[Speaker for High-Tone Playback Purpose Using Magnesium Diaphragm]

FIGS. 5 through 7 show various examples in which the magnesium diaphragms. Each of which has been manufactured through the previously-described rolling process and has a thickness within the range of 30 μm to 100 μm. Are applied to a dynamic speaker capable of effecting high-tone playback. The shapes of the magnesium diaphragms shown in various examples shown below are defined, by pressing the magnesium sheet 24 formed through the previously-described rolling process and through use of a press. The forming method is not a feature of the present invention, and various known methods are applicable. Hence, their explanations are omitted.

Figure 5A:
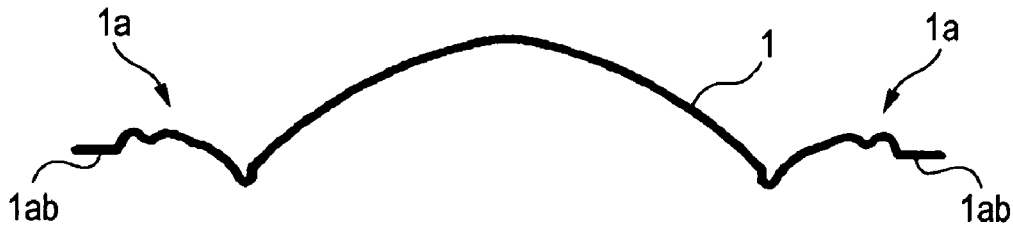
FIGS. 5A and 5B show an example in which the magnesium diaphragm of the present invention is applied to a semi-dome-shaped dynamic speaker.
Figure 5B:
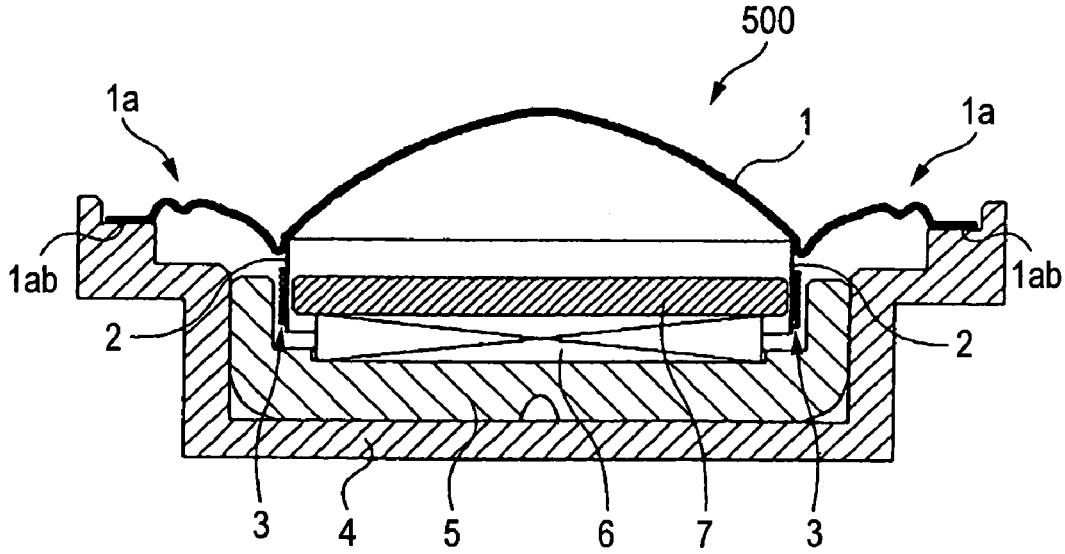

Example of Application of the Magnesium Diaphragm to a Semi-Dome Dynamic Speaker FIG. 5A is a cross-sectional view of the magnesium diaphragm 1 formed into a semi-dome shape. FIG. 5B shows, in the form of a cross-sectional view, an example of application of the semi-dome magnesium diaphragm 1 to a dynamic speaker.

By reference to FIG. 5B, the basic configuration and principle of the semi-dome dynamic speaker 500 will be described. As shown in FIG. 5B, the semi-dome dynamic speaker 500 comprises a vibration system including the magnesium diaphragm 1, a voice coil bobbin 2, and a voice coil 3; and a magnetic circuit system including a barrel yoke 5, a magnet 6, and a plate 7.

The magnesium diaphragm 1 is a substantially-semi-spherical (so-called "semi-dome-shaped") diaphragm having an opening formed in a portion of the diaphragm facing a speaker. The diaphragm is formed integrally with an edge section 1*a*. A lower end section lab of the edge section 1*a* is fixed on one upper end face of a resin plate 4 constituting a housing along the peripheral direction of the speaker. The magnesium diaphragm 1 is secured so as to clamp an upper portion of an outer side wall surface of the voice coil bobbin 2.

The voice coil bobbin 2 assumes a substantially-cylindrical shape having an opening in a lower surface thereof, and the voice coil 3 is wrapped around an external wall of the voice coil bobbin 2. The external wall of the voice coil bobbin 2 opposes, at a given interval, an internal side wall surface of the barrel yoke 5 having an essentially cylindrical shape having an opening formed in an upper surface thereof. The internal wall surface of the voice coil bobbin 2 opposes, respectively with a given interval, the external wall surface of the disk-shaped magnet 6 and the external wall surface of the disk-shaped plate 7 having a diameter slightly larger than that of the magnet 6. As a result, a gap (a magnetic gap) is defined between the external wall surface of the plate 7 and the internal wall surface of the barrel yoke 5.

In the semi-dome-shaped dynamic speaker 500 having the foregoing configuration, a sound current flows through the voice coil 3 remaining in a uniform magnetic field, whereupon the voice coil bobbin 2 is vibrated vertically in the axial direction of the speaker on the basis of the principle of electromagnetic action. The vibration is then transmitted to the magnesium diaphragm 1, and a sound wave is radiated from the magnesium diaphragm 1.

Example Application of the Magnesium Diaphragm to a Dome-Shaped Speaker

Figure 6A:
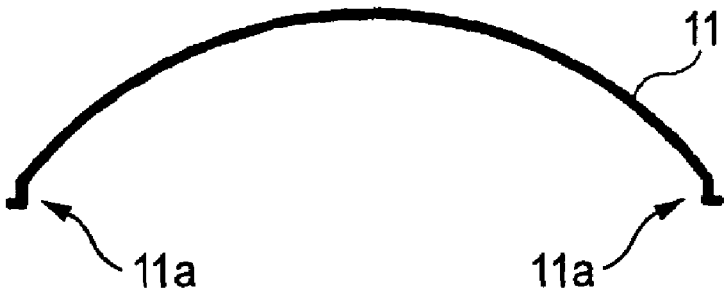
FIGS. 6A and 6B show an example in which the magnesium diaphragm of the present invention is applied to a dome-shaped dynamic speaker separately comprising a dome section and an edge section.
Figure 6B:
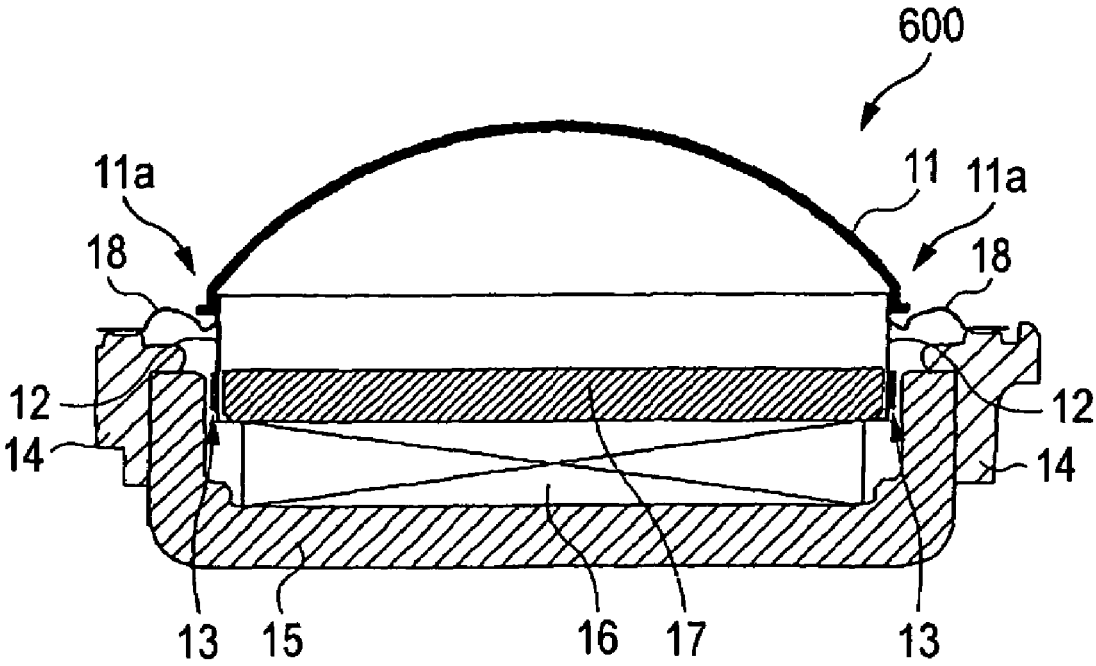

FIG. 6A provides a cross-sectional view of the magnesium diaphragm 11 formed into a dome shape. FIG. 6B shows, in the form of a cross-sectional view, an example application of a magnesium diaphragm 11 to a dynamic speaker.

As shown in FIG. 6B, the dome-shaped dynamic speaker 600 comprises a vibration system including the magnesium diaphragm 11, a voice coil bobbin 12, a voice coil 13, and an edge section 18; and a magnetic circuit system including a barrel yoke 15, a magnet 16, and a plate 17.

The dynamic speaker is essentially identical with the previously-described semi-dome-shaped dynamic speaker 500 in terms of configuration and principle. The semi-dome-shaped dynamic speaker 500 is slightly different in configuration from the dome-shaped dynamic speaker 600. Hence, an explanation is given below solely for a different configuration.

First, as shown in FIG. 6B, the dome-shaped dynamic speaker 600 comprises the magnesium diaphragm 11 formed into the shape of a dome, and the edge section 18, which are separate from each other. An edge 11*a* of the magnesium diaphragm 11 and one end of the edge section 18 are fixed to upper portions of the external wall surface of the voice coil bobbin 13 in a circumferential direction. The other end of the edge section 18 and one upper end of the resin plate 14 are fixed to each other in a circumferential direction. The resin plate 14, which is to be a housing, is formed into an essentially-ring-shaped form. The resin plate 14 is fixed such that the internal wall surface of the resin plate 14 and the external wall surface of the barrel yoke 15 come into close contact with each other in a circumferential direction.

Figure 7A:
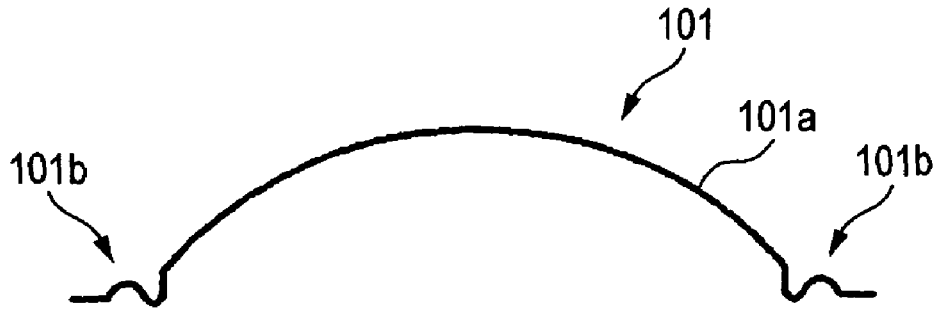
FIGS. 7A and 7B show an example in which the magnesium diaphragm of the present invention is applied to a dome-shaped dynamic speaker integrally comprising a dome section and an edge section.
Figure 7B:
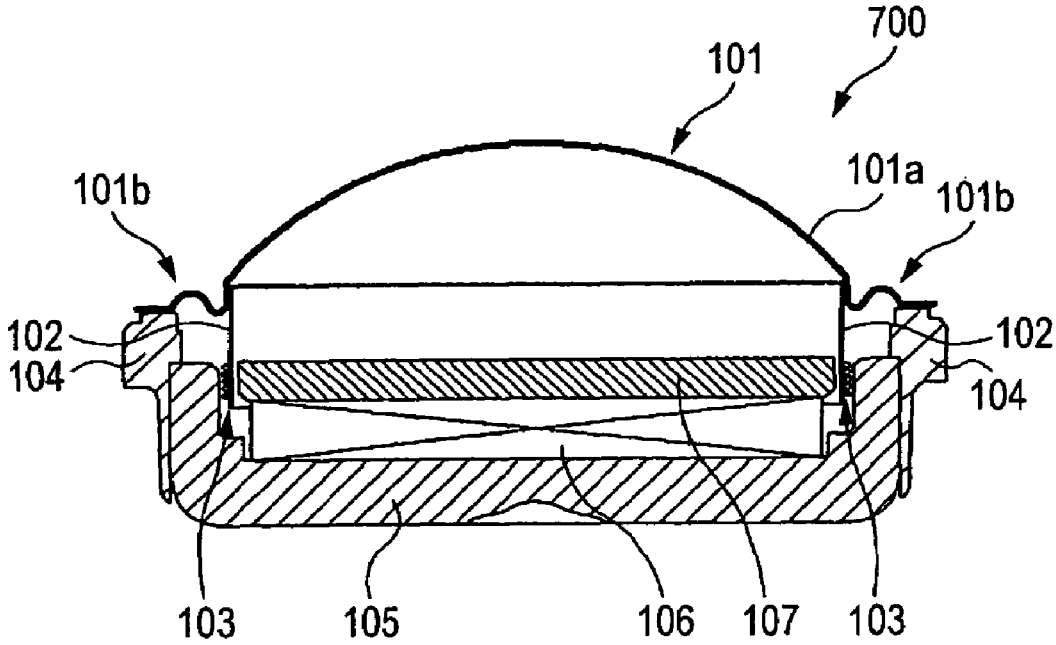

Example of Application of the Magnesium Diaphragm to a Dynamic Speaker into Which a Dome Section and an Edge Section are Integrated Together FIG. 7A provides a cross-sectional view of a magnesium diaphragm 101 into which a dome section 101*a* and an edge section 101*b* are formed integrally, and FIG. 7B provides a cross-sectional view showing an example of application of the magnesium diaphragm 101 to a dynamic speaker 700.

As shown in FIG. 7B, the dynamic speaker 700 to which the magnesium diaphragm 101 is applied, the diaphragm being formed by integrating the dome section 101*a* and the edge section 101*b*, comprises a vibration system including the magnesium diaphragm 101, a voice coil bobbin 102, and a voice coil 103; and a magnetic circuit system including a barrel yoke 105, a magnet 106, and a plate 107.

This dynamic speaker 700 is generally identical with the previously-described semi-dome-shaped dynamic speaker 500 in terms of the basic configuration and principle. They slightly differ from each other in terms of the shape of the resin plate 104 which is to be a housing. The dynamic speaker 700 is generally identical with the previously-described dynamic speaker 600 in terms of the shape of the resin plate 104 and the coupled state of the barrel yoke 105.

The magnesium diaphragm of the present embodiment can be formed into various shapes, such as a semi-dome shape, a dome shape, and an edge-integrated shape, which have already been described, in accordance with an application. In particular, when the magnesium diaphragm into which the dome section and the edge section are integrally formed is applied to a speaker, a task for fixing the dome section and the edge section later can be omitted. Therefore, the number of manufacturing process can be reduced, and the speakers can be produce inexpensively. Moreover, the speaker into which the dome section and the edge section are formed integrally also yields an advantage of prevention of a loss when sound speed is transmitted, because the dome section and the edge section are formed integrally.

In the embodiment, in order to make the magnesium substrate 20 easy to roll, the magnesium substrate 20 is rolled while being heated by the thermostatic chamber 22. However, the invention is not limited to this embodiment. Heaters capable of controlling a temperature may be provided in the respective rollers 21*a*, 21*b*, 21*c*, and 21*d*, and the magnesium substrate 20 may be rolled while being heated. Instead of this method, the rollers 21*a*, 21*b*, 21*c*, and 21*d* and the thermostatic chamber 22 may be activated to roll the magnesium substrate 20 while the substrate is heated.

As has been described, according to the method for manufacturing the magnesium diaphragm of the present invention, a high-quality magnesium diaphragm, which is free from occurrence of cracks, warpage, or pinholes and has a thickness of 30 μm to 100 μm, can be manufactured by repeating a rolling process a plurality of times such that the level of rolling changes from one operation to another. Therefore, an attempt can be made to improve a yield. Further, as a result of the magnesium diaphragm being given a thickness of 30 μm to 100 μm, the diaphragm becomes a diaphragm for a high-tone playback which is less susceptible to oxidation, can maintain a high internal loss, and achieves low distortion without involvement of a drop in sensitivity. Further, as a result of the magnesium diaphragm being formed into a semi-dome shape or a dome shape, the diaphragm can be manufactured inexpensively as a speaker for high-tone playback. In particular, in the case of the magnesium diaphragm into which the dome section and the edge section are formed integrally, without lowering sensitivity, high quality sound can be played back in a high-frequency range.

What is claimed is:

1. A method for manufacturing a magnesium diaphragm, comprising:

(a) setting a rolling amount to a first value;

(b) heating a base material of magnesium;

(c) rolling the heated base material of magnesium a plurality of times at the rolling amount;

(d) setting the rolling amount to a second value, which is different than the first value, and repeating operations (b) and (c);

(e) after operation (d), producing a magnesium sheet having a predetermined thickness from the base material of magnesium; and (f) forming a magnesium diaphragm from the magnesium sheet.

2. The method for manufacturing a magnesium diaphragm according to claim 1, wherein the predetermined thickness of the magnesium sheet ranges from 30 μm to 100 μm.

3. The method for manufacturing a magnesium diaphragm according to claim 1, wherein the first value and the second value range from 1 μm to 20 μm.

4. The method for manufacturing a magnesium diaphragm according to claim 1, wherein the magnesium diaphragm is formed in a semi-dome shape or a dome shape.

5. The method for manufacturing a magnesium diaphragm according to claim 1, wherein the second value is less than the first value.

6. A method for manufacturing a magnesium diaphragm, comprising:

(a) setting a rolling amount to a first value;

(b) rolling base material of magnesium a plurality of times at the rolling amount; and (c) setting the rolling amount to a second value and repeating operation (b), wherein the second value is different than the first value.

7. The method according to claim 6, wherein operation (b) comprises:

(b1) heating the base material to a temperature based on the rolling amount; and (b2) rolling the heated base material a plurality of times at the rolling amount.

8. The method according to claim 6, wherein operation (b) comprises:

(b1) applying a tension to the base material based on the rolling amount; and (b2) rolling the tensioned base material a plurality of times at the rolling amount.

9. The method according to claim 6, wherein operation (b) comprises:

(b1) heating the base material to a temperature based on the rolling amount;

(b2) applying a tension to the base material based on the rolling amount; and (b3) rolling the heated and tensioned base material a plurality of times at the rolling amount.

10. The method according to claim 6, further comprising:

(d) after operation (c), producing a magnesium sheet having a predetermined thickness from the base material of magnesium.

11. The method according to claim 10, further comprising:

(e) forming a magnesium diaphragm from the magnesium sheet.

12. The method according to claim 11, wherein the predetermined thickness of the magnesium sheet ranges from 30 μm to 100 μm.

13. The method according to claim 6, wherein the first value and the second value range from 1 μm to 20 μm.

14. The method according to claim 6, wherein the second value is less than the first value.

* * * * *